US007726936B2

(12) United States Patent
Keller et al.

(10) Patent No.: US 7,726,936 B2
(45) Date of Patent: Jun. 1, 2010

(54) TURBINE ENGINE RING SEAL

(75) Inventors: Douglas A. Keller, Oviedo, FL (US); Steven J. Vance, Orlando, FL (US); Christian X. Campbell, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 808 days.

(21) Appl. No.: 11/492,590

(22) Filed: Jul. 25, 2006

(65) Prior Publication Data

US 2010/0104426 A1 Apr. 29, 2010

(51) Int. Cl.
*F04D 29/08* (2006.01)

(52) U.S. Cl. ..... 415/173.4; 415/174.2; 415/214.1

(58) Field of Classification Search ..... 415/173.5, 415/171.1, 173.1, 173.3, 173.4, 173.6, 174.1, 415/174.2, 174.3, 214.1, 215.1, 134, 135, 415/139; 416/244 R See application file for complete search history.

(56) References Cited

U.S. PATENT DOCUMENTS 4,357,377 A * 11/1982 Yamamoto ..... 428/40.3
4,536,127 A * 8/1985 Rossmann et al. ..... 415/173.4
4,626,461 A 12/1986 Prewo et al.
5,304,031 A 4/1994 Bose
5,738,490 A 4/1998 Pizzi
5,851,679 A 12/1998 Stowell et al.
6,013,592 A 1/2000 Merrill et al.
6,089,821 A 7/2000 Maguire et al.
6,197,424 B1 3/2001 Morrison et al.
6,235,370 B1 5/2001 Merrill et al.
6,287,511 B1 9/2001 Merrill et al.
6,331,496 B2 12/2001 Nakayasu
6,342,269 B1 1/2002 Yoshida et al.
6,397,603 B1 6/2002 Edmondson et al.
6,641,907 B1 11/2003 Merrill et al.
6,670,046 B1 12/2003 Xia
6,676,783 B1 1/2004 Merrill et al.
6,733,907 B2 5/2004 Morrison et al.
6,758,653 B2 * 7/2004 Morrison ..... 415/173.4
6,920,762 B2 7/2005 Wells et al.
2004/0047725 A1 3/2004 Tomita et al.

FOREIGN PATENT DOCUMENTS

DE 102 35 485 A1 12/2004
GB 2 235 253 A 2/1991
JP 08312961 A 11/1996

* cited by examiner

*Primary Examiner*—Edward Look
*Assistant Examiner*—Dwayne J White

(57) ABSTRACT

Aspects of the invention relate to a ring seal for a turbine engine. The ring seal can be made up of a plurality of circumferentially abutted ring seal segments. Each ring seal segment can comprise a plurality of individual channels. The channels can be generally U-shaped in cross-section with a forward span, and aft span and an extension connecting therebetween. The channels can be positioned such that the aft span of one channel can substantially abut the forward span of another channel. The plurality of separate channels can be detachably coupled to each other by, for example, a plurality of pins. The ring seal segment according to aspects of the invention can facilitate numerous advantageous characteristics including greater material selection, selective cooling, improved serviceability, and reduced blade tip leakage. Moreover, the configuration is well suited to handle the operational loads of the turbine.

16 Claims, 6 Drawing Sheets

TURBINE ENGINE RING SEAL

FIELD OF THE INVENTION

Aspects of the invention relate in general to turbine engines and, more particularly, to ring seals in the turbine section of a turbine engine.

BACKGROUND OF THE INVENTION

FIG. 1 shows an example of one known turbine engine 10 having a compressor section 12, a combustor section 14 and a turbine section 16. In the turbine section 16 of a turbine engine, there are alternating rows of stationary airfoils 18 (commonly referred to as vanes) and rotating airfoils 20 (commonly referred to as blades). Each row of blades 20 is formed by a plurality of airfoils 20 attached to a disc 22 provided on a rotor 24. The blades 20 can extend radially outward from the discs 22 and terminate in a region known as the blade tip 26. Each row of vanes 18 is formed by attaching a plurality of vanes 18 to a vane carrier 28. The vanes 18 can extend radially inward from the inner peripheral surface 30 of the vane carrier 28. The vane carrier 28 is attached to an outer casing 32, which encloses the turbine section 16 of the engine 10.

Between the rows of vanes 18, a ring seal 34 can be attached to the inner peripheral surface 30 of the vane carrier 28. The ring seal 34 is a stationary component that acts as a hot gas path guide between the rows of vanes 18 at the locations of the rotating blades 20. The ring seal 34 is commonly formed by a plurality of metal ring segments. The ring segments can be attached either directly to the vane carrier 28 or indirectly such as by attaching to metal isolation rings (not shown) that attach to the vane carrier 28. Each ring seal 34 can substantially surround a row of blades 20 such that the tips 26 of the rotating blades 20 are in close proximity to the ring seal 34.

During engine operation, high temperature, high velocity gases flow through the rows of vanes 18 and blades 20 in the turbine section 16. The ring seals 34 are exposed to these gases as well. Some metal ring seals 34 must be cooled in order to withstand the high temperature. In many engine designs, demands to improve engine performance have been met in part by increasing engine firing temperatures. Consequently, the ring seals 34 require greater cooling to keep the temperature of the ring seals 34 within the critical metal temperature limit. In the past, the ring seals 34 have been coated with thermal barrier coatings to minimize the amount of cooling required. However, even with a thermal barrier coating, the ring seal 34 must still be actively cooled to prevent the ring seal 34 from overheating and burning up. Such active cooling systems are usually complicated and costly. Further, the use of greater amounts of air to cool the ring seals 34 detracts from the use of air for other purposes in the engine.

As an alternative, the ring seals 34 could be made of ceramic matrix composites (CMC), which have higher temperature capabilities than metal alloys. By utilizing such materials, cooling air can be reduced, which has a direct impact on engine performance, emissions control and operating economics. However, CMC materials have their own drawbacks. For instance, CMC materials (oxide and non-oxide based) have anisotropic strength properties. The interlaminar tensile strength (the "through thickness" tensile strength) of CMC can be substantially less than the in-plane strength. Anisotropic shrinkage of the matrix and the fibers can result in de-lamination defects, particularly in small radius corners and tightly-curved sections, which can further reduce the interlaminar tensile strength of the material.

Thus, there is a need for a CMC ring seal construction that can minimize the limiting aspects of CMC material properties and manufacturing constraints.

SUMMARY OF THE INVENTION

Aspects of the invention are directed to a turbine engine ring seal segment. The ring seal segment includes a first channel and a second channel. Each of the channels is shaped so as to form an extension that transitions into a forward span and an aft span. The forward and aft spans are opposite each other and extend at an angle from the extension in a radially outward direction. Each of the channels can have an outer surface and an inner surface, which can be radially inwardly concave. The inner surface of the extension of the first and/or second channel can be coated with a thermal insulating material. In one embodiment, the thickness of the thermal insulating material can decrease along the extension in the axial direction.

Each channel can include a transition region between each of the forward and aft spans and the axial extension. The first and/or second channels can be preloaded so that at least a portion of each transition region is placed in compression in the through thickness direction.

The first and second channels are detachably coupled such that the aft span of the first channel substantially abuts the forward span of the second channel. As a result, an axial interface is defined. In one embodiment, the first and second channels can be detachably coupled by a plurality of fasteners that operatively engage the aft span of the first channel and the forward span of the second channel. The axial interface can be sealed. To that end, a seal and/or a bonding material can operatively engage the aft span of the first channel and the forward span of the second channel.

The first and second channels can be made of any suitable material. For instance, the first channel and/or the second channel can be made of ceramic matrix composite. However, one or both of the channels can be made of a material other than a ceramic matrix composite. Further, the first and second channels can be made of different materials.

In another respect, aspects of the invention relate to a turbine engine ring seal system. The system includes a turbine stationary support structure and a first ring seal segment operatively connected to the turbine stationary support structure, by, for example, a plurality of fasteners. The first ring seal segment includes a first channel and a separate second channel. Each of the channels can have an inner surface, which can be radially inwardly concave, and an outer surface.

Further, each of the first and second channels is shaped so as to form an extension that transitions into a forward span and an aft span. The forward and aft spans are opposite each other and extend at an angle from the extension in a radially outward direction. At least the inner surface of the extension of one or both of the channels can be coated with a thermal insulating material.

Each channel can include a transition region between the forward span and the axial extension as well as between the aft span and the axial extension. The first channel and/or the second channel can be preloaded so that at least a portion of each transition region can be compressed in the through thickness direction.

The first and second channels are detachably coupled such that the aft span of the first channel substantially abuts the forward span of the second channel. As a result, an axial interface is defined. Coolant leakage through the axial interface can be minimized in various ways. For example, in one embodiment, one or more seals can operatively engage the aft span of the first channel and the forward span of the second channel such that the axial interface is substantially sealed.

The first and second channels can be made of any suitable material. For example, the first channel and/or the second channel can be made of ceramic matrix composite. In one embodiment, the first and second channels can be made of different materials.

In one embodiment, the system can also include a second ring seal segment that includes a first channel and a separate second channel. Each of the first and second channels can have a radially inwardly concave surface. Further, the first and second channels can be shaped so as to form an extension that transitions into a forward span and an aft span. The forward and aft spans can be opposite each other and can extend at an angle from the extension in a radially outward direction.

The first and second channels can be detachably coupled such that the aft span of the first channel substantially abuts the forward span of the second channel. As a result, an axial interface can be defined. In one embodiment, the first and second channels can be detachably coupled by a plurality of fasteners that operatively engage the aft span of the first channel and the forward span of the second channel.

Both the first ring seal segment and the second ring seal segment can include opposite circumferential ends. One of the circumferential ends of the first ring seal segment can substantially abut one of the circumferential ends of the second ring seal segment so as to define a circumferential interface. The circumferential interface can be substantially sealed to minimize coolant leakage through the circumferential interface. To that end, one or more seals can be attached to the outer surface of the first channel of the first ring seal segment such that they extend circumferentially beyond one of the circumferential ends of the first ring seal segment and into engagement with the outer surface of the first channel of the second ring seal segment. Alternatively or in addition, one or more seals can operatively engage the circumferential ends of the first and second ring seal segments that form the circumferential interface.

DETAILED DESCRIPTION OF EMBODIMENTS OF THE INVENTION

Figure 3:
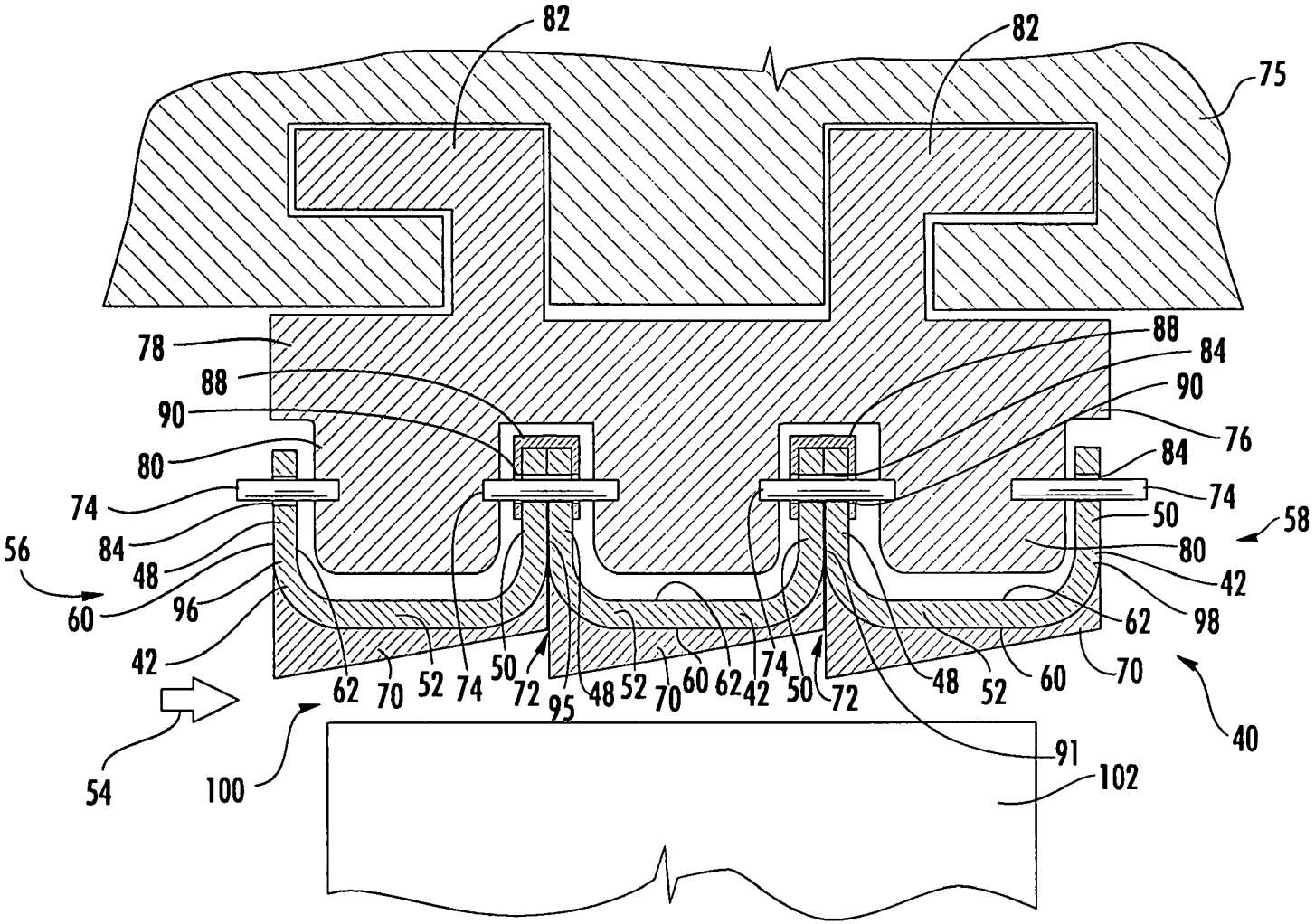
FIG. 3 is a cross-sectional elevation view of a ring seal segment according to aspects of the invention, showing one manner of attaching the ring seal segment to a turbine stationary support structure.
Figure 4:
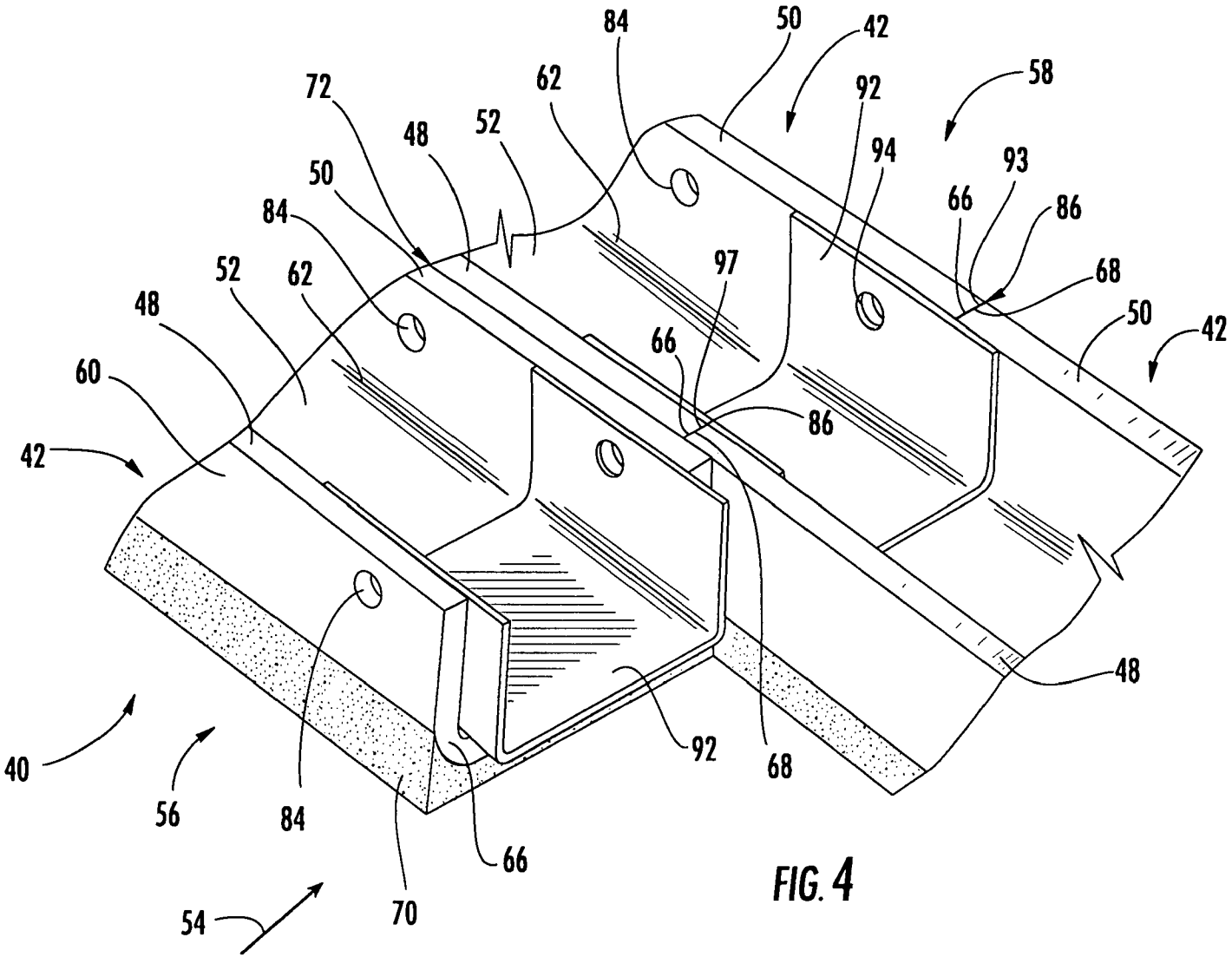
FIG. 4 is an isometric view of a ring seal segment according to aspects of the invention, showing circumferentially offset channels and one manner of sealing between circumferentially abutting ring seal segments.

Embodiments of the invention are directed to a construction for a turbine engine ring seal segment that can better distribute the operational stresses imposed thereon. Aspects of the invention will be explained in connection with one possible ring seal segment, but the detailed description is intended only as exemplary. An embodiment of the invention is shown in FIGS. 2-4, but the present invention is not limited to the illustrated structure or application.

Figure 1:
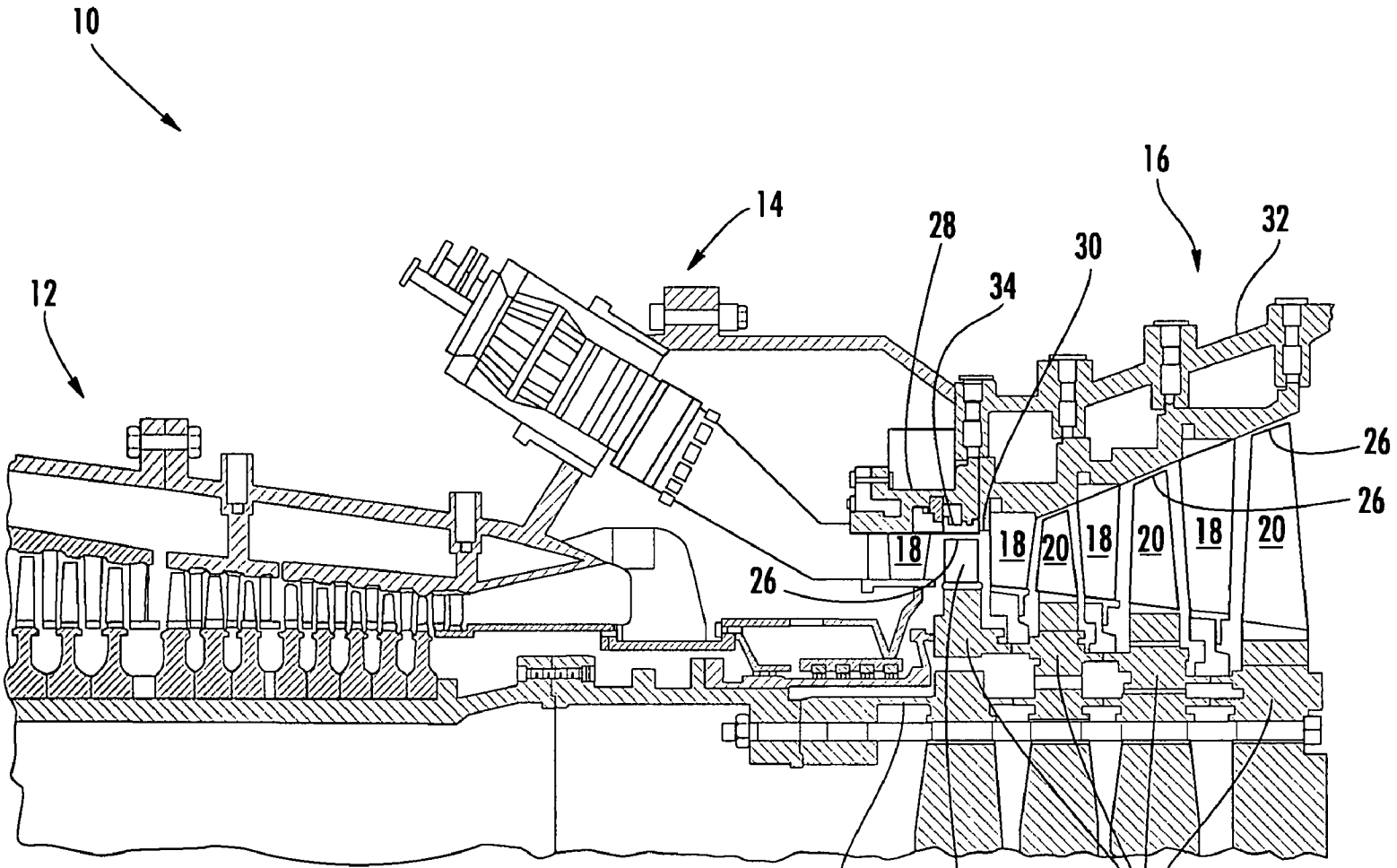
FIG. 1 (PRIOR ART)
FIG. 1 is a cross-sectional view of the turbine section of a known turbine engine.
Figure 2:
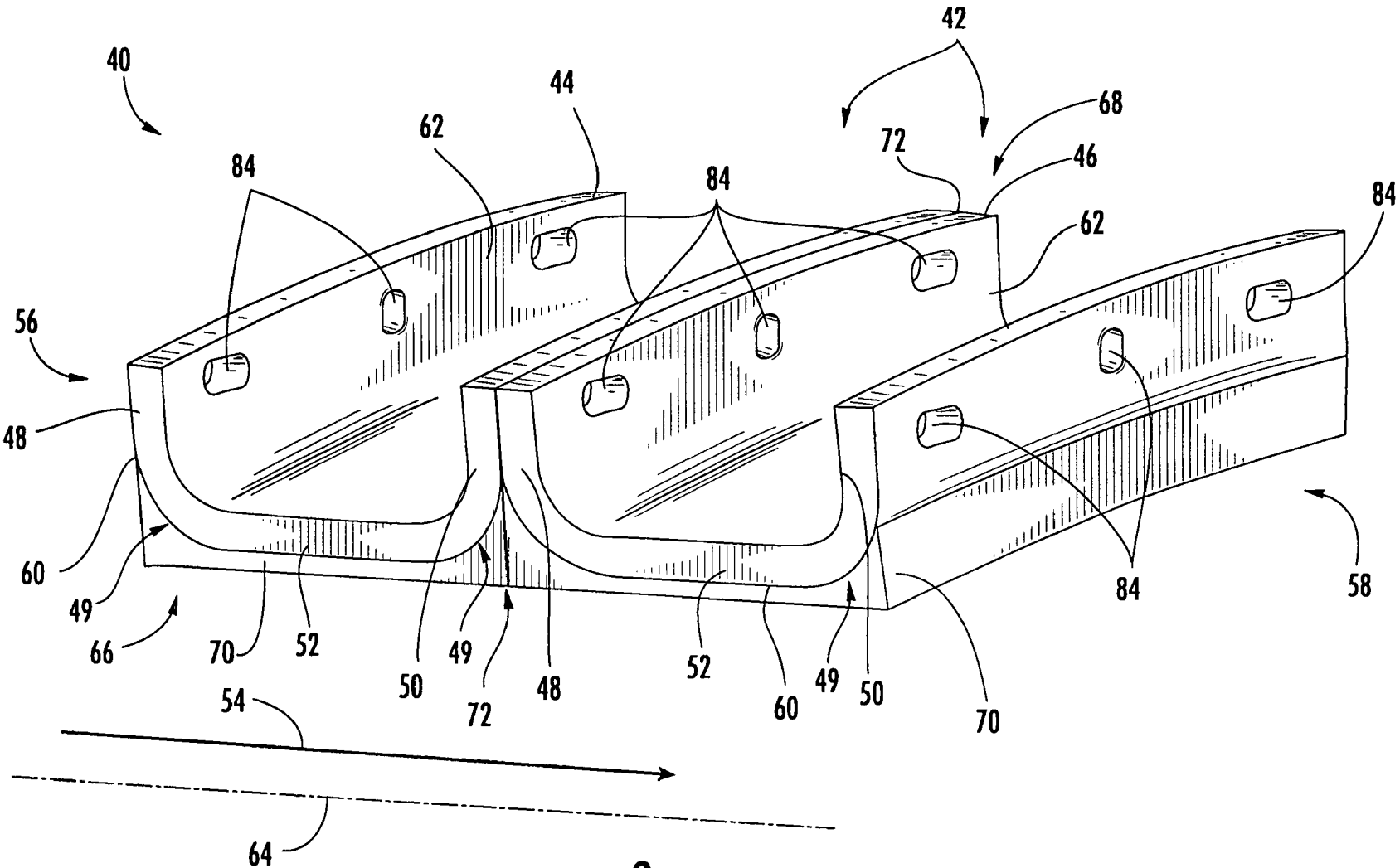
FIG. 2 is an isometric view of a ring seal segment according to aspects of the invention.

FIG. 2 shows a ring seal segment 40 according to aspects of the invention. The ring seal segment 40 can include a plurality of separate channels 42. In one embodiment, there can be a first channel 44 and a second channel 46. The first and second channels 44, 46 can have a generally U-shaped cross-section. Each of the channels 44, 46 can include a forward span 48 and an aft span 50. The forward span 48 and the aft span 50 of each channel 44, 46 can be connected by an axial extension 52. The terms "forward" and "aft" are intended to mean relative to the direction of the gas flow 54 through the turbine section when the ring seal segment 40 is installed in its operational position. The ring seal segment 40 can have an axial upstream end 56 and an axial downstream end 58. Each ring seal segment 40 can have an inner surface 60 and an outer surface 62. The inner surface 60 can be radially inwardly concave.

The forward span 48 and the aft span 50 can extend from the extension 52 in a generally radially outward direction. In one embodiment, the forward and aft spans 48, 50 can extend at substantially 90 degrees from the extension 52. Thus, when the ring seal segment 40 is in its operational position, the forward and aft spans 48, 50 can extend substantially radially outward relative to the axis of the turbine 64. The spans 48, 50 can extend at angles greater than or less than 90 degrees so as to form an acute or obtuse angle relative to the extension 52. The forward and aft spans 48, 50 can extend at the same angle or at different angles relative to the extension 52. There can be a transition region 49 between each of the spans 48, 50 and the axial extension 52. The transition region 49 can be configured as a fillet.

The ring seal segment 40 can have a first circumferential end 66 and a second circumferential end 68. The term "circumferential" is intended to mean relative to the turbine axis 64 when the ring seal segment 40 is installed in its operational position. The ring seal segment 40 can be curved circumferentially as it extends from the first circumferential end 66 to the second circumferential end 68.

The first and second channels 44, 46 can be made of any material suited for the high temperature and operational loads of the turbine environment. For instance, the first and second channels 44, 46 can be made of ceramic matrix composite (CMC). In one embodiment, the first and second channels 44, 46 can be made of an oxide-oxide CMC, such as AN-720, which is available from COI Ceramics, Inc., San Diego, Calif. At least one of the first and second channels 44, 46 can be made of a hybrid oxide CMC. An example of such a such a material system is disclosed in U.S. Pat. No. 6,733,907, which is incorporated herein by reference. However, the channels 44, 46 can be made of other CMC materials, including non-oxide based CMCs. Further, the channels can be made of non-CMC materials.

The first and second channels 44, 46 can be made of the same material, but, in some embodiments, the first and second channels 44, 46 can be made of different materials. Thus, material selection can be optimized based on different requirements along the ring seal segment 40. For example, a high temperature CMC may be well suited for those channels 42 that form or are proximate the axial upstream end 56 of the ring seal segment 40. Those channels 42 forming or located near the axial downstream end 58 of the ring seal segment 40, where the temperature and pressure of the combustion gases have decreased, can be made of a different CMC or a non-CMC material.

A CMC material includes a ceramic matrix and a plurality of fibers within the matrix. The fibers of the CMC can be arranged as needed to achieve the desired strength characteristics. For instance, the fibers 70 can be oriented to provide anisotropic, orthotropic, or in-plane isotropic properties. In one embodiment, a substantial portion of the fibers at least in the extension 52 of each channel 44, 46 can be substantially parallel to the turbine gas flow path 54. In one embodiment, the fibers can be arranged at substantially 90 degrees relative to each other, such as a 0-90 degree orientation or a +/−45 degree orientation. The fibers in the forward and aft spans 48, 50 can extend substantially parallel to the direction of each of those spans 48, 50. Again, these are merely examples as the fibers 70 of the CMC can be arranged as needed.

The first and the second channels 44, 46 are formed separately by any suitable process. When made of CMC, the channels 44, 46 can be formed by any suitable fabrication technique, such as winding, weaving and lay-up. The first and second channels 44, 46 can be substantially identical to each other. However, aspects of the invention also include embodiments in which at least one of the plurality of channels 42 is different from the other channels 42 in at least one respect including any of those discussed above. In one embodiment, the axial length of the extension 52 of the first channel 44 and the axial length of the extension 52 of the second channel 46 can be different. Alternatively or in addition, the thickness of the extension 52 of the first channel 44 can be different from the thickness of the extension 52 of the second channel 46.

At least a portion of the first and second channels 44, 46 can be coated with a thermal insulating material 70. For instance, the thermal insulating material 70 can be applied to the inner surface 60 of each channel 44, 46 in the extension 52 or other portions of the channels 44, 46 that would otherwise be exposed to the combustion gases 54 in the turbine. In one embodiment, the thermal insulating material 70 can be friable graded insulation (FGI). Various examples of FGI are disclosed in U.S. Pat. Nos. 6,676,783; 6,670,046; 6,641,907; 6,287,511; 6,235,370; and 6,013,592, which are incorporated herein by reference. The thermal insulating material 70 can be attached to each channel 44, 46 individually.

The first and second channels 44, 46 can be arranged in an axially abutted manner so as to collectively form the ring seal segment 40. For example, the aft span 50 of the first channel 44 can substantially abut the forward span 48 of the second channel 46 to thereby form an axial interface 72. The term "substantially abut" and variants thereof is intended to mean that at least a portion of the forward and aft spans 48, 50 forming the interface directly contact each other, or they can be slightly spaced.

The circumferential ends 66, 68 of the first channel 44 can be substantially flush with the circumferential ends 66, 68 of the second channel 46, as shown in FIG. 2. Alternatively, the first circumferential end 66 and/or the second circumferential end 68 of the first channel 44 can be staggered or otherwise offset from the respective circumferential end 66 and/or 68 of the second channel 46. FIG. 4 shows an example in which the first circumferential end 66 of one channel 42 is slightly offset from the first circumferential end 66 of a substantially axially abutting channel 42. However, aspects of the invention include any suitable amount of offset. For instance, the circumferential end of one channel can extend to approximately the circumferentially middle region of the axially abutting channel.

The abutting channels 44, 46 can be detachably coupled to each other in any of a number of ways. For example, the first and second channels 44, 46 can be detachably coupled by one or more elongated fasteners, such as a pin 74 as shown in FIG. 3. Because they are detachably coupled, the channels 44, 46 can be quickly separated, which can significantly facilitate removal and installation of the channels 44, 46. Thus, it will be appreciated that the ring seal segment 40 according to aspects of the invention can provide significant advantages during assembly, disassembly, service, repair and/or replacement.

The ring seal segment 40 can be operatively connected to one or more stationary support structures in the turbine section of the engine including, for example, the engine casing, a vane carrier 75 or one or more isolation rings. The ring seal segment 40 can be directly or indirectly connected to any of these stationary support structures. FIG. 3 shows an embodiment in which the ring seal segment 40 can be operatively connected to a stationary support structure by an adapter 76. The adapter 76 can include a base 78 and a plurality protrusions 80 extending radially inward therefrom. Each of the protrusions 80 can extend in one of the channels 42 of the ring seal segment 40 between the forward and aft spans 46, 48. The adapter 76 can be made of metal. The adapter 76 can be configured for attachment to a turbine stationary support structure. For example, the adapter 76 can include hooks 82 or other attachment features that are known.

The channels 42 can be attached to the adapter 76 by, for example, pins 74 or other elongated fasteners. To that end, the forward and aft spans 48, 50 of each channel 42 can include cutouts 84. The cutouts 84 can be substantially aligned so that an elongated fastener can be passed therethrough and into engagement with the adapter 76. The fasteners can engage the adapter 76 in various ways including, for example, threaded engagement. To accommodate differential thermal growth of the fasteners and the channels 42, the cutouts 84 can be slotted or oversized. Any suitable quantity of fasteners can be used to connect the forward and aft spans 48, 50 of each channel 42 to the adapter 76. In one embodiment, the forward and aft spans 48, 50 of each channel 42 can be operatively connected to the adapter 76 by three pins 74. The pins 74 can be arranged in any suitable manner.

Additional ring seal segments 40 can be attached to the stationary support structure in a similar manner to that described above. The plurality of the ring seal segments 40 can be installed so that each of the circumferential ends 66, 68 of one ring seal segment 40 substantially abuts one of the circumferential ends 66, 68 of a neighboring ring seal segment 40 so as to collectively form an annular ring seal. The substantially abutting circumferential ends 66, 68 of the ring seal segments 40 can form a circumferential interface 86 (see FIG. 4).

During engine operation, a coolant, such as air, can be supplied to the outer surface 62 of the ring seal segments 40. The coolant can be delivered through one or more passages (not shown) in the adapter 76. The coolant can be supplied at a high pressure to prevent the hot combustion gases 54 from infiltrating past the ring seal segments 40. The components beyond the ring seal segments 40 are typically not designed to withstand the high temperatures of the combustion gases 54. However, there is a potential for coolant to leak into the turbine gas path 54 through the axial interface 72 between abutting channels 42 and/or the circumferential interface 86 between abutting ring seal segments 40. Such coolant leakage can adversely impact engine performance. To minimize the escape of coolant through the axial and circumferential interfaces 72, 86, there can be various sealing systems operatively associated with the ring seal segment 40.

With respect to the axial interface 72, one or more seals can operatively engage portions of the forward and aft spans 48, 50 of two adjacent channels 42 that form the interface 72. FIG. 3 shows an example of a sealing system for an axial interface 72 according to aspects of the invention. As shown, one or more seals 88 can generally wrap around the ends of the forward and aft spans 48, 50 of two adjacent channels 44. The seals 88 can be generally U-shaped and can be made of any suitable material. The seals 88 can be held in place in various ways. For example, the seals 88 can include cutouts 90 to allow the pins 74 to pass therethrough, thereby holding the seals 88 in place. The seals 88 can also be bonded to the outer surface 62 of at least one the channels 42 forming the interface 72.

Alternatively or in addition, one or more seals 91 and/or bonding material 95 can be applied between the outer surfaces 62 of the channels 42 that form the interface 72, such as between the aft span 50 of one channel 42 and the forward span 48 of a axially downstream channel 42, as shown in FIG. 3. The seals 91 can be, for example, high temperature metal seals, felt seals, rope seals or U-Plex seals (which are available from PerkinElmer Fluid Sciences, Beltsville, Md.). The seals 91 can allow independent motion of the aft span 50 and the forward span 48, which form the interface 72. The bonding material 95 can be, for example, any suitable bonding material, such as a high temperature ceramic adhesive, high temperature metallic braze or a glass frit. Though it may further couple the channels 42, the bonding material 95 can be removed using a band-saw or other cutting operation so as to separate the channels 42 during service.

Likewise, leakage through the circumferential interface 86 can be minimized in various ways. In one embodiment, one or more seals 92 can operatively engage portions of each of the circumferentially abutting channels 42 forming the circumferential interface 86. FIG. 4 shows an example of a sealing system for the circumferential interface 86. As shown, one or more seals 92 can be nestled inside each channel 42. The seal 92 can generally follow the contour of the outer surface 62 of the channel 42. The seal 92 can extend along the entire circumferential length of the channel 42, or it can be provided proximate one or both of the circumferential ends 66, 68, such as shown in FIG. 4.

A portion of the seal 92 can extend beyond one or both of the circumferential ends 66, 68 of each channel 42. The extending portion can be received in the neighboring channel 42 of an adjacent ring seal segment 40. The seal 92 can be any suitable seal. In one embodiment, the seal 92 can be made of sheet metal. In another embodiment, the seal 92 can be made of CMC. The seal 92 can be held in place in any suitable manner. For instance, the seal 92 can include cutouts 94. In such case, the pin 74 connecting the channels 42 can also hold the seal 92 in place. The seal 92 can be pinned to one or both of the neighboring channels 42 forming the circumferential interface 86. The seal 92 can be bonded to one or both of the channels 42 forming the interface 86.

Alternatively or in addition, one or more seals 93 and/or bonding material 97 can be applied between the inner surfaces 60 of the channels 42 that form the circumferential interface 86, such as between the first circumferential end 66 of one channel 42 and the second circumferential end 68 of a circumferentially adjacent channel 42, as shown in FIG. 4. The seals 93 can be, for example, high temperature metal seals, felt seals, rope seals or U-Plex seals (which are available from PerkinElmer Fluid Sciences, Beltsville, Md.). The seals 93 can allow independent motion of the aft span 50 and the forward span 48, which form the interface 86. The bonding material 97 can be, for example, any suitable sealing material, such as a high temperature ceramic adhesive, high temperature metallic braze or a glass frit. While it may further couple the channels 42, the bonding material 97 can be removed using a band-saw or other cutting operation so as to separate the channels 42 during service.

Further, as discussed above, the circumferential interfaces of the first channels can be staggered or otherwise offset from the circumferential interfaces of the second channels. As a result, a tortuous path for any potential leakage flow is created.

The ring seal segment according to aspects of the invention can manage the loads that it is subjected to during engine operation. In prior ring seal segment designs, an area of high stress occurs at corner regions. The stress is directly related to bending load at these corner regions. The load is mainly imposed by the pressure of the coolant supplied to the backside of the ring seal segment. The ring seal segment according to aspects of the invention is well suited to reduce the load by increasing the number of reaction points. That is, by breaking the ring seal segment into a plurality of U-shaped channels, as described above, each channel can carry a portion of the bending load proportional to its axial length. Thus, the greater the number of separate channels forming the ring seal segment, the lower the bending stress in each channel, resulting in lower interlaminar stresses (for CMC channels) and increased structural integrity. Because the multi-channel ring seal design according to aspects of the invention can distribute the stresses imposed on the ring seal segment, the thickness of the individual channels can be reduced. The reduced thickness of the channels can lead to material cost savings and can reduce thermal gradients across each channel.

The ring seal segment 40 according to aspects of the invention can be configured to minimize interlaminar tensile stresses that can develop along the transition regions 49 of each channel 42. To that end, the channels 42 can be preloaded; that is, at least a portion of the transition region 49 can be placed in interlaminar compression in the through thickness direction, which can extend from one of the inner surface 60 and the outer surface 62 to the opposite one of the inner and outer surfaces 60, 62. Generally, such preload can be achieved by forcing the forward and aft spans 48, 50 of the channels 42 toward each other. Such preloading can greatly increase the load carrying capability of the ring seal segment 40.

Figure 5B:
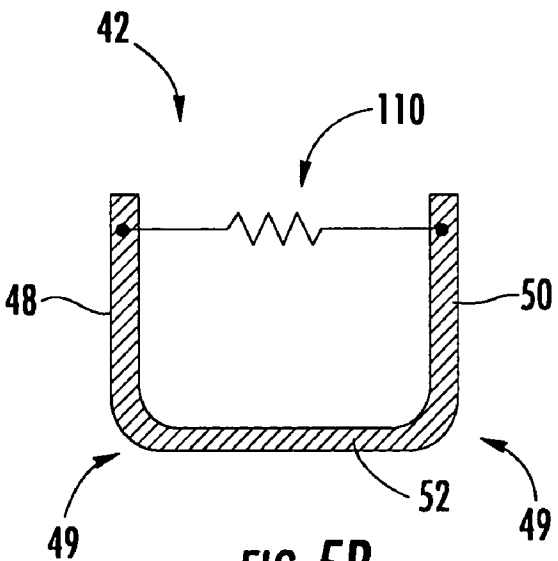
FIG. 5B is a cross-sectional elevation view of the channel of FIG. 5A, showing the forward and aft spans being held together by a spring force such that the channel is preloaded.
Figure 5A:
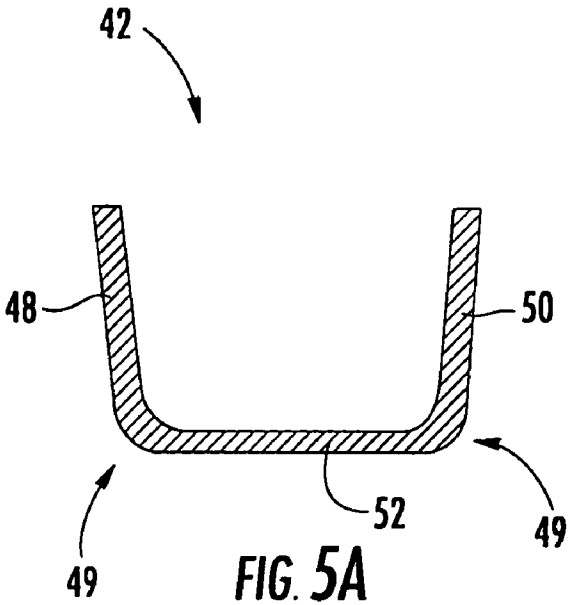
FIG. 5A is a cross-sectional elevation view of a single channel of a ring seal segment according to aspects of the invention, showing the forward and aft spans extending from the axial extension at angles greater than 90 degrees.

FIGS. 5A and 5B show one manner in which the channels 42 of the ring seal segment 40 can be preloaded. As shown in FIG. 5A, the channel 42 can be formed or otherwise made so that forward and aft spans 48, 50 extend at an angle greater than 90 degrees relative to the axial extension 52. For instance, the forward and aft spans 48, 50 can extend at about 92 degrees relative to the axial extension 52. The forward and the aft spans 48, 50 can be pressed toward each other. In one embodiment, the forward and aft spans 48, 50 can be pressed toward each other until each of the spans 48, 50 extends at about 90 degrees relative to the axial extension 52. The spans 48, 50 can be held in such position. For example, as shown in FIG. 5B, the forward and aft spans 48, 50 can be held together under the load of a spring 110. The spring 110 can be operatively connected to the forward and aft spans 48, 50 in any suitable manner.

Figure 6A:
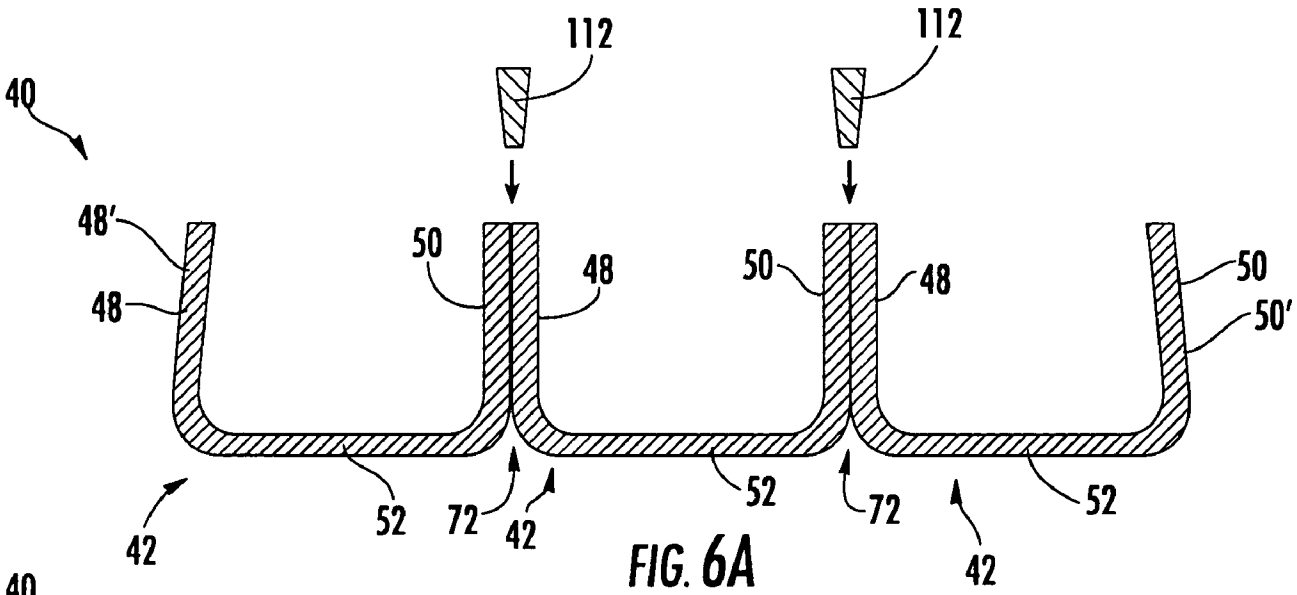
FIG. 6A is a cross-sectional elevation view of a ring seal segment according to aspects of the invention, showing wedges being driven into the axial interface between adjacent channels.
Figure 6B:
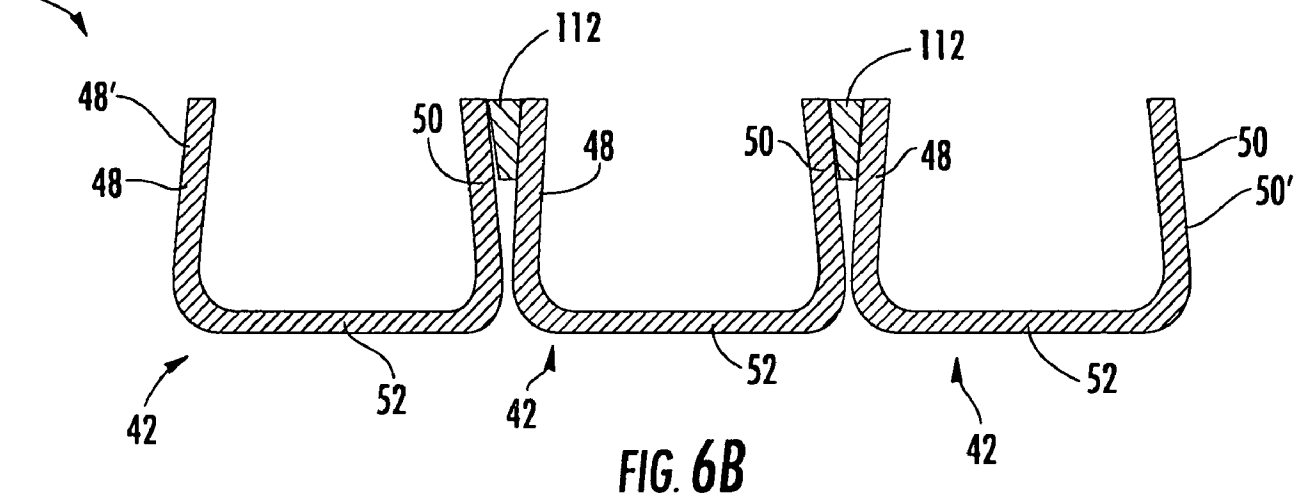
FIG. 6B is a cross-sectional elevation view of the ring seal segment of FIG. 6A, showing the wedges driven into the axial interface between adjacent channels such that the forward and aft spans forming the interface become bent inward so as to preload the individual channels.

In an alternative embodiment, shown in FIGS. 6A and 6B, the preloading of the channels 42 can be achieved by using one or more wedges 112. In such case, the channels 42 can be formed with forward and aft spans 48, 50 that extend at substantially 90 degrees relative to the axial extension 52. The forward most span 48' and the aft most span 50' of the entire ring seal segment 40 can be formed so that the spans 48', 50' extend at less than 90 degrees relative to the axial extension 52. In one embodiment, the spans 48', 50' can extend at about 88 degrees relative to the axial extension 52.

Wedges 112 can be provided. The wedges can have any suitable shape and can be made of any suitable material. The wedges 112 can be driven between the spans 48, 50 forming the axial interface 72. As a result, the spans 48, 50 forming the interface 72 can be forced toward the opposite span of the channel 42. The wedges 112 can be held in place in any suitable manner.

The above preloading arrangements can place a compressive load on the transition regions 49 of each channel 42 in the through thickness direction. Such a compressive load is particularly beneficial when the channels 42 are made of CMC because CMCs are especially strong in compression in the through thickness direction. As a result, stress on the transition region 49 can be reduced, allowing the ring seal segment to carry the backside coolant loads, as discussed previously.

Because the ring seal segment 40 is formed by a plurality of individual channels 42, the ring seal can expand the possible cooling schemes for the ring seal segments 40. As is known, the pressure of the combustion gases 54 decreases as the gases 54 travel through the turbine section. According to aspects of the invention, the coolant supplied to the individual channels 42 of the ring seal segment 40 can be controlled to account for such a decrease in pressure. For instance, referring to FIG. 3, the coolant can be delivered to the upstream channel 96 at a first pressure and to the downstream channel 98 at a second pressure. The first pressure can be greater than the second pressure. The difference between the first and second pressure can be commensurate with the decrease in pressure of the combustion gases 54. The pressure of the coolant flow can be reduced in any of a number of ways including, for example, by orifice holes or impingement plates. In cases where the coolant is being delivered to the individual channels 42 of the ring seal segment 40 at selectively controlled pressures, seals (not shown) can be provided to minimize or prevent coolant infiltration from one channel 42 into another.

The configuration of a ring seal segment 40 in accordance with aspects of the invention can further aid in minimizing the leakage of hot combustion gases 54 in the clearance 100 between the ring seal segment 40 and the neighboring row of turbine blades 102. Such leakage flow can decrease engine efficiency. To minimize such leakage, the thermal insulating coating 70 can be staggered along the gas path 54 so as to create a more tortuous path for gases 50 to flow between the ring seal segment 40 and the nearby blades 102. FIG. 3 shows one example of a staggered thermal insulating coating 70 in accordance with aspects of the invention. As shown, the thickness of the thermal insulating coating 70 on each channel 42 can decrease in the axial downstream direction. In one embodiment, the thermal insulating coating 70 can decrease in a planar manner, as shown in FIG. 3. However, the thickness of the thermal insulating coating 70 can decrease in any of a number of non-planar manners as well. Such an arrangement can serve to reduce the leakage flow of hot gas 54 over the tips of the blades 102, which can result in measurable performance benefits.

The foregoing description is provided in the context of one possible ring seal segment for use in a turbine engine. Aspects of the invention are not limited to the examples presented herein. While the above discussion concerns a ring seal segment, the construction described herein has equal application to a full 360 degree ring seal body. Further, the following description concerned a ring seal segment made of two separate channels. However, it will be understood that the ring seal segment can be made of more than two channels. Thus, it will of course be understood that the invention is not limited to the specific details described herein, which are given by way of example only, and that various modifications and alterations are possible within the scope of the invention as defined in the following claims.

What is claimed is:

1. A turbine engine ring seal segment comprising:

a first channel having a radially inwardly concave surface, the first channel being shaped so as to form an extension transitioning into a forward span and an aft span, the forward and aft spans being opposite each other and extending at an angle from the extension in a radially outward direction, wherein the extension of the first channel includes an outer surface that is exposed to turbine blades in use;

a separate second channel having a radially inwardly concave surface, the second channel being shaped so as to form an extension transitioning into a forward span and an aft span, the forward and aft spans being opposite each other and extending at an angle from the extension in a radially outward direction, wherein the extension of the second channel includes an outer surface that is exposed to turbine blades in use, the first and second channels being detachably coupled such that the aft span of the first channel substantially abuts the forward span of the second channel so as to define an axial interface and the extensions for the first and second channels form a uninterrupted planar surface across the entirety of the extensions; and at least one of a seal and a bonding material operatively engaging the aft span of the first channel and the forward span of the second channel.

2. The turbine engine ring seal segment of claim 1 wherein at least one of the first and second channels is made of ceramic matrix composite.

3. The turbine engine ring seal segment of claim 1 wherein each channel includes a transition region between each of the forward and aft spans and the axial extension, wherein at least one of the first and second channels is preloaded, whereby at least a portion of each of the transition regions is placed in compression in the through thickness direction.

4. The turbine engine ring seal segment of claim 1 wherein at least one of the channels is made of a material other than a ceramic matrix composite.

5. The turbine engine ring seal segment of claim 1 wherein the first and second channels are made of different materials.

6. The turbine engine ring seal segment of claim 1 wherein each of the channels includes an inner surface and an outer surface, wherein at least the inner surface of the extension of at least one of the channels is coated with a thermal insulating material.

7. The turbine engine ring seal segment of claim 6 wherein the thickness of the thermal insulating material decreases along the extension in the axial direction.

8. The turbine engine ring seal segment of claim 1 further including a plurality of fasteners, wherein each fastener operatively engages the aft span of the first channel and the forward span of the second channel such that the first and second channels are detachably coupled.

9. A turbine engine ring seal system comprising:

a turbine stationary support structure; and a first ring seal segment operatively connected to the turbine stationary support structure, the ring seal segment including a first channel and a separate second channel, the first channel having a radially inwardly concave surface, the first channel being shaped so as to form an extension transitioning into a forward span and an aft span, the forward and aft spans being opposite each other and extending at an angle from the extension in a radially outward direction;

the second channel having a radially inwardly concave surface, the second channel being shaped so as to form an extension transitioning into a forward span and an aft span, the forward and aft spans being opposite each other and extending at an angle from the extension in a radially outward direction, the first and second channels being detachably coupled such that the aft span of the first channel substantially abuts the forward span of the second channel, thereby defining an axial interface; and at least one seal operatively engaging the aft span of the first channel and the forward span of the second channel such that the axial interface is substantially sealed, whereby coolant leakage through the axial interface is minimized;

a second ring seal segment including a first channel and a separate second channel, the first channel having a radially inwardly concave surface, the first channel being shaped so as to form an extension transitioning into a forward span and an aft span, the forward and aft spans being opposite each other and extending at an angle from the extension in a radially outward direction, the second channel having a radially inwardly concave surface, the first channel being shaped so as to form an extension transitioning into a forward span and an aft span, the forward and aft spans being opposite each other and extending at an angle from the extension in a radially outward direction, the first and second channels being detachably coupled such that the aft span of the first channel substantially abuts the forward span of the second channel, thereby defining an axial interface, wherein each of the first and second ring seal segments includes opposite circumferential ends, and wherein one of the circumferential ends of the first ring seal segment substantially abuts one of the circumferential ends of the second ring seal segment to thereby define a circumferential interface; and at least one seal operatively engaging the circumferential ends of the first and second ring seal segments that form the circumferential interface such that the circumferential interface is substantially sealed, whereby coolant leakage through the circumferential interface is minimized.

10. The turbine engine ring seal system of claim 9 wherein the first ring seal segment is operatively connected to the stationary support structure by a plurality of fasteners.

11. The turbine engine ring seal system of claim 9 wherein at least one of the first and second channels is made of ceramic matrix composite.

12. The turbine engine ring seal system of claim 9 wherein the first and second channels are made of different materials.

13. The turbine engine ring seal system of claim 9 wherein each of the channels includes an inner surface and an outer surface, wherein at least the inner surface of the extension of at least one of the channels is coated with a thermal insulating material.

14. The turbine engine ring seal segment of claim 9 wherein each channel includes a transition region between each of the forward and aft spans and the axial extension, wherein at least one of the first and second channels is preloaded, whereby at least a portion of each of the transition regions is placed in compression in the through thickness direction.

15. The turbine engine ring seal system of claim 9 wherein each of the channels includes an outer surface, and further including at least one seal attached to the outer surface of the first channel of the first ring seal segment so as to extend circumferentially beyond one of the circumferential ends of the first ring seal segment and into engagement with the outer surface of the first channel of the second ring seal segment, whereby the circumferential interface is substantially sealed.

16. The turbine engine ring seal segment of claim 15 further including a plurality of fasteners, wherein each fastener operatively engages the aft span of the first channel and the forward span of the second channel such that the first and second channels are detachably coupled.

* * * * *